US006588972B1

(12) United States Patent
Bergeson et al.

(10) Patent No.: US 6,588,972 B1
(45) Date of Patent: Jul. 8, 2003

(54) STANDOFF BLOCK

(75) Inventors: Robert J. E. Bergeson, Buzzards Bay, MA (US); John P Vanderhoef, Cummaquit, MA (US)

(73) Assignee: Selectech Inc., Tawnton, MA (US)

( * ) Notice: Subject to any disclaimer, the term of this patent is extended or adjusted under 35 U.S.C. 154(b) by 0 days.

(21) Appl. No.: 10/150,470

(22) Filed: May 17, 2002

(51) Int. Cl.[7] ..... E01F 15/00
(52) U.S. Cl. ..... 404/6; 256/13.1
(58) Field of Search ..... 404/6, 9, 10; 256/13.1, 256/19, 59; 52/603, 604, 606; 405/15

(56) References Cited

U.S. PATENT DOCUMENTS

| | | | | | |
|---|---|---|---|---|---|
| D348,737 | S | * | 7/1994 | Yang | D25/133 |
| 5,429,449 | A | * | 7/1995 | Baatz | 404/6 |
| 5,503,496 | A | | 4/1996 | Voigt | 404/10 |
| 5,507,473 | A | * | 4/1996 | Hammer et al. | 256/13.1 |
| 5,607,252 | A | | 3/1997 | Tischer | 404/6 |
| 6,007,269 | A | | 12/1999 | Marinelli | 404/6 |
| 6,071,044 | A | | 6/2000 | Ricciardelli et al. | 405/286 |
| 6,168,346 | B1 | * | 1/2001 | Ernsberger | 404/6 |
| 6,179,273 | B1 | | 1/2001 | Edmunds, III et al. | 256/13.1 |
| 6,308,936 | B1 | | 10/2001 | Atwood | 256/13.1 |
| 6,530,560 | B2 | * | 3/2003 | King | 256/1 |

OTHER PUBLICATIONS

U.S. published application 20010048101A1, Bligh Dec. 2001.

* cited by examiner

*Primary Examiner*—Robert E. Pezzuto
*Assistant Examiner*—Raymond W. Addie
(74) *Attorney, Agent, or Firm*—Jerry M. Presson; Thomas F. Presson

(57) ABSTRACT

A plastic standoff block having a substantially H-shape cross-section that is used for mounting a guardrail barrier to a vertical support post. The standoff block has horizontally disposed dual compression-resisting zones comprised of two back-to-back cavitated block modules joined by a common vertically disposed support base. In accordance with one embodiment, the support base extends outwardly from the modules to form a peripheral shoulder for a plurality of elongated horizontally disposed struts that buttress the modules against transverse buckling.

24 Claims, 3 Drawing Sheets

STANDOFF BLOCK

BACKGROUND

1. Field of the Invention

This invention relates generally to a plastic block apparatus. More particularly, this invention relates to a plastic standoff block that is used to mount a roadway guardrail to an upright support post.

2. Background Art

Conventional standoff blocks are typically composed of plastic or rubber materials and have been approved by the Federal Highway Administration (FHWA) of the U.S. Department of Transportation for mounting steel W-beam type guardrails to steel support posts. These guardrails find extensive use as barriers along roadways to prevent vehicles from veering off the roadway area.

Trinity Industries, Inc. of Dallas Tex., uses an injection molding process to produce one conventional standoff block. The Trinity block is composed of a mixture of recycled material that consists of approximately sixty-seven percent high density polyethylene (HDPE), approximately thirty percent granulated rubber, approximately two percent black color concentrate and approximately one percent, or less, of a blowing agent. This Trinity block has a cavitated or honeycomb-like interior region formed by injection molding constituent materials. Blocks of such compositions, approved for standoff usage, have external dimensions of approximately four inches in.width; approximately 7.3 inches in depth, or horizontal dimension; and, approximately 14 inches in height, or vertical dimension. The rearward, or post, end of the Trinity block includes a horizontal tab-like protrusion projecting rearward from the top edge to overlie a post top thereby enabling the block to be hung from the post substantially vertically during the installation of the W-beam type rail element. The:forward, or rail, face of the block mounting the rail element has a horizontal frontward projecting tab-like protrusion at its bottom edge that underlies the bottom edge of the rail and thereby temporarily supports the rail on the post for ease of installation with conventional through bolts.

Standard guardrail installations, with which the Trinity and other prior art plastic standoff blocks are designed, are required to pass certain high-impact tests approved by the FHWA. The specifics of these tests are available to standoff block manufacturers in published form and FWHA acceptance is based upon the monitored impact resistance of the tested block in a simulated barrier environment.

Because standoff blocks are required to sustain high horizontal directed compressed impact forces, they are molded with cavitated interiors that somewhat resemble a corrugated or honeycomb structure.

It is known to those working in the art of plastic injection molding that both compressive and torque resistance may be accorded rectangular-shaped injection-molded, structures by designing the structure with a honeycomb interior. This interior design is achieved by open-ended cavities formed by the injection molding process. These cavities, which are elongated in the general horizontal direction of the impact forces, are formed by a plurality of elongated, laterally spaced apart interior web-like walls depending at right angles from a common generally planar support base. One example of this type of cavitated structure is disclosed in U.S. Pat. No. 6,071,044, issued to Thomas E. Ricciardelli et al., and is assigned to the same assignee as the instant invention. U.S. Pat. No. 6,071,044 is hereby incorporated by reference in its entirety herein.

Conventional cavitated structures may be molded from virgin or recycled plastic compositions and may be characterized as having an overall U-shaped cross-section; such shape being defined by a pair of laterally spaced apart, parallel exterior side walls and a perpendicular support base or end wall. Thus, the design of conventional cavitated structures is essentially completely U-shaped.

The interior cavities of conventional cavitated structures are formed by injecting molten plastic into a series of parallel, elongated, closed-ended mold cores that extend like fingers from the planar core chambers. The plastic core chambers define the web base and extend perpendicular to the finger-like mold cores. The mold core fingers define the web-like cavity walls and extend forwardly from their base the remaining depth or horizontal dimension of the block. Thus, if the block depth is on the order of seven inches, the mold core fingers might have lengths on the order of six inches each.

A disadvantage of designing a conventional standoff block with a substantially U-shape and a single cavitated interior is that the substantial horizontal dimension of the block requires that the injection molding apparatus have lengthy mold cores for forming the cavity walls. These lengthy mold cores cause the molten plastic material to cool as it is injected into and fills the cores from the base channel. The extremities of the cores forming the open ends of the cavitated structure receive injected plastic at the lowest temperatures, which may be cool enough to cause solidification of the molten plastic before it completely fills the mold core ends. When such plastic solidification occurs before the core ends are completely filled, the web-like interior walls defined by the core will contract, or shrink, more rapidly causing possible deformation of the end product. Thus, a longer flow path will result in increased shrinkage during solidification of the molten plastic material, which may result in cavity walls and their compressive-resistant characteristics being non-uniform and, in some cases, reduced. Such non-uniformity is undesirable from a strength perspective, and moreover, makes the removal of the cavity walls from the mold more difficult.

Therefore, conventional U-shaped cross-section cores, which have relatively long, finger-like sections, cause the compression-resistant characteristics of the structures to be somewhat unpredictable and make the injection-molding process inefficient due to imperfect and/or deformed structures.

It would be desirable, and it is an object of the instant invention, to provide a standoff block design that does not suffer the aforementioned disadvantages of conventional standoff block designs.

SUMMARY OF THE INVENTION

The instant invention is directed to a guardrail block for joining a rail section to a vertically disposed support post. The standoff block is molded from plastic material into a substantially H-shaped cross-section, with a horizontal impact resistant cavitated module formed within each U-shaped half of the substantially H-shaped block. Upon installation, the outer.cavitated end of a first module abuts the rail and the outer cavitated end of a second module abuts the post. The inner ends of the modules join to form a vertical central support structure from which plural horizontal exterior struts extend toward the outer ends of the modules to buttress the block against transverse buckling.

The struts may project horizontally beyond the post end of the module to straddle, and thereby position, the block on the post.

Accordingly, one embodiment of the instant invention is directed to a standoff block structure for mounting a rail structure of a roadway guardrail to a support post. The block piece mounted there between is composed at least partially of recycled plastic material and including first and second elongated block elements of substantially rectangular cross-sectional shape for providing impact resistance to the guardrail. Each of the block elements has a longitudinal axis, a cored interior formed by longitudinally extending open-ended cavities having open ends thereof at one end of each of the block elements. The open end of the first block element is adapted to abut the rail and the open end of the second block element is adapted to abut the post. The block includes a buttressing structure and a center plate is disposed substantially perpendicularly to the longitudinal axis and interposed between the ends of the block elements opposite the open ends thereof. The center plate joins the opposite ends of the block elements and defines the bottoms of the cavities. At least one bore extends through the block elements and the plate in a direction substantially parallel to the longitudinal axis for receiving a rail mounting fastener.

Another embodiment of the instant invention is directed to a plastic standoff block for mounting a guardrail to an upright support post. The block includes a pair of cavitated-open ended modules for resisting impact forces. Each of the modules is enclosed by a pair of spaced apart, substantially parallel sidewalls and a rearward end wall portion joining the sidewalls to provide a structure of substantially H-shaped cross-section. Each of the modules is further enclosed by respective upper and lower parallel edge walls joined to opposite respective ends of the structure. The sidewalls have a central axis extending there between in a vertical direction and the edge walls have a central axis extending there between in a horizontal direction and intersecting the central, vertically disposed axis at a substantially right angle thereto. A plurality of elongated, vertically spaced-apart interior walls extend from the rearward end wall portion substantially the length of the sidewalls to form the cavitated end of each of the modules, and the rearward end portions are joined together to mount the modules in longitudinal alignment with the cavitated ends thereof and are positioned to face the guardrail and post, respectively.

Yet another embodiment of the instant invention is.directed to a standoff block.molded from plastic material that includes first and second block elements, each block element having a honeycomb interior formed by plural, laterally spaced elongated interior walls having substantially parallel longitudinal axes. The block also includes a support wall interposed between the interior walls perpendicular to the longitudinal axes and joining the first and second block elements in a fixedly aligned relationship.

DETAILED DESCRIPTION OF THE INVENTION

Figure 5:
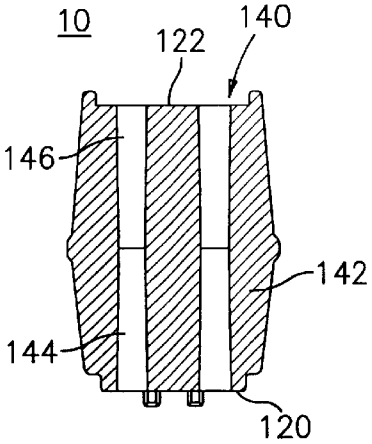
FIG. 5 shows a sectional side view of the block shown in FIG. 2 taken through section line 5—5 of FIG. 2.

For the purposes of promoting an understanding of the principles of the invention, reference will now be made to the embodiments illustrated in the drawings, and specific language will be used to describe the same. It will, nevertheless, be understood that no limitation of the scope of the invention is thereby intended. Any alterations and further modifications in the described embodiments and further applications of the principles of the invention as described herein are contemplated as would normally occur to one skilled in the art to which the invention relates.

Figure 1:
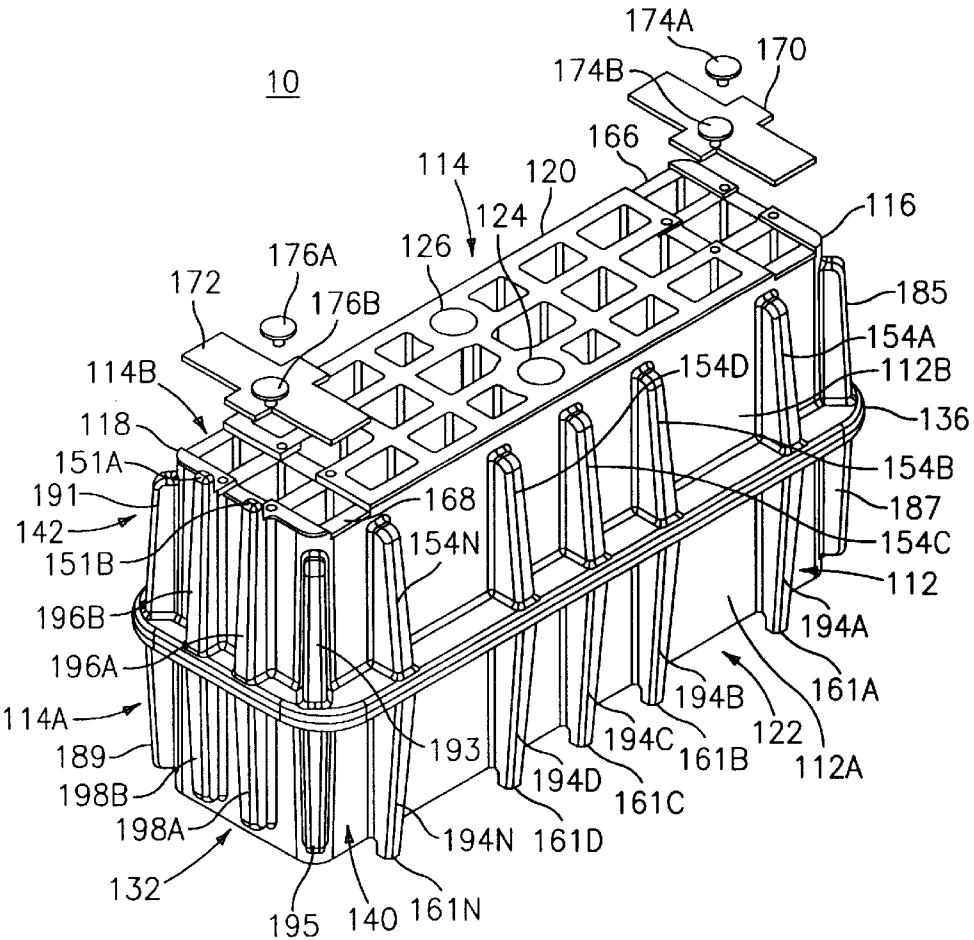
FIG. 1 shows an isometric perspective view of a standoff block constructed in accordance with this invention.
Figure 4:
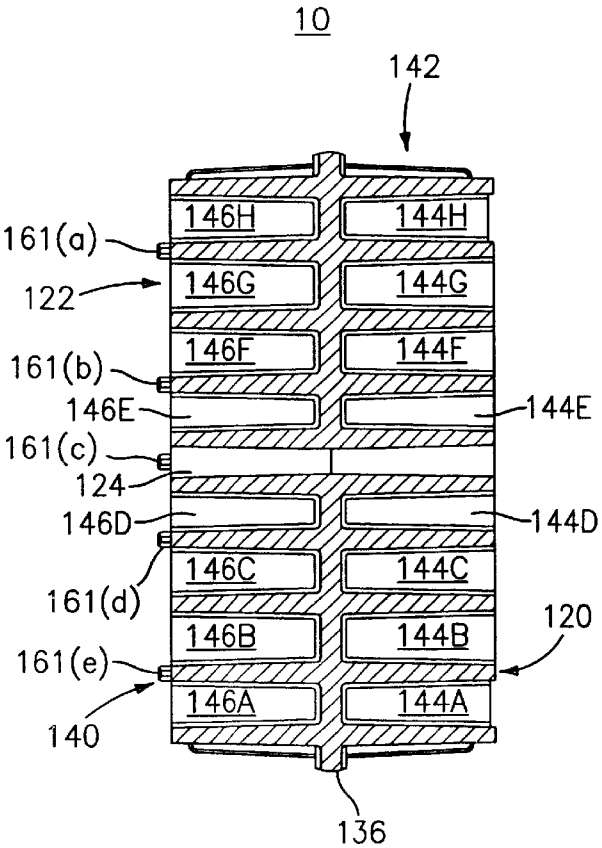
FIG. 4 shows a cross-sectional side view of the block illustrated in FIG. 2.

As shown in FIG. 1, the standoff block according to this invention is composed primarily of recycled plastic material, so as to be environmentally friendly. The standoff block 10 has an overall rectangular shape with opposite parallel sidewalls 112 and 114, each of which has a generally rectangular shape, and opposite parallel.top and bottom walls 116 and 118, respectively. Frontward or rail surface portion 120 is designed to be positioned against a rearward surface of a section of a standard W-beam guardrail (not shown). Rearward or post surface portion, 122, is disposed to abut the front surface of a vertical post, not shown. A pair of bolts (not shown) may be inserted in the horizontal direction through the rail section and with both holes provided in the post by way of throughbores 124, 126, which extend horizontally through the block 10. The diameter of the walls of the throughbores 124, 126 are slightly reduced approximately halfway through the horizontal length of the block 10 to slightly grip the bolts inserted into the throughbores 124, 126, thereby facilitating bolt retention in the rail while the block mounting installation is being performed. (Reduced diameter of throughbores 124, 126 is shown in FIG. 4.)

Figure 2:
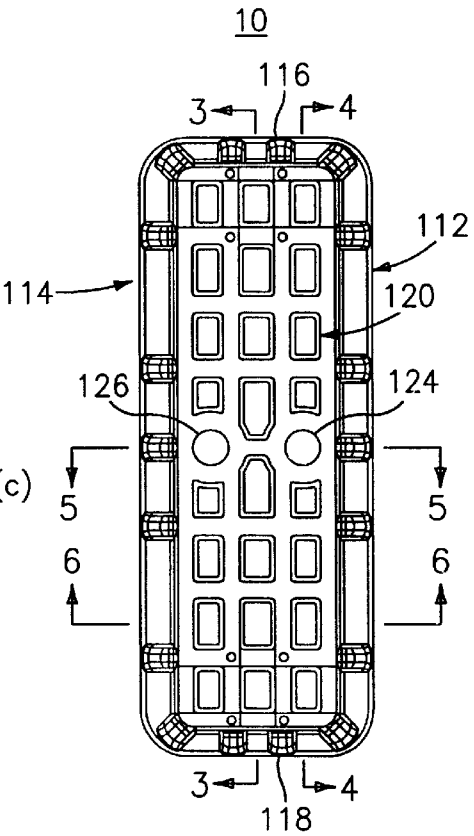
FIG. 2 shows an end elevation view of the block as viewed from the post module end.

The pair of flat, parallel exterior sidewalls 112, 114, respectively, is intersected by a centrally disposed planar support base 136. The base 136 is disposed in a plane perpendicular to a plane extending parallel to the planes of the sidewalls 112, 114 and spaced approximately halfway therebetween. (The latter plane containing the horizontal axis 5—5 and vertical axis 3—3 of the block 10, which is shown in FIG. 2.) The sidewalls 112 and 114 have a width of approximately 7 inches, which is approximately equal to the spacing between the rail and the post.

The support base 136 divides the sidewall 112 into two equal sidewall sections 112A and 112B, respectively. The base 136 similarly divides the sidewall 114 into two equal sections 114A and 114B, respectively. The sidewalls 112A and 114A along with one-half of the thickness of the base 136 form the housing of the post-facing compression-resisting module 140, which has substantially U-shaped cross-section, whereas the sidewalls 112B and 114B along with the opposite half of the base 136 thickness form the housing for the rail-facing compression-resisting module 142 of similar substantially U-shaped cross-section. With a common central base 136, the overall cross-sectional shape of the block 10 resembles a substantially H-shaped cross section formed by the abutting substantially U-shaped compression-resisting modules 140 and 142, commonly joined to the base 136. Advantageously, the compression-resisting modules 140 and 142 are molded with honeycombed or corrugated interior structures that occupy each of the compression-resisting zones provided between the module sidewall pairs 112A, 114A and 112B and 114B, respectively.

The rail facing surface 120 has a recess adjacent each upper and lower wall 116, 118, respectively, to provide a pair of slots 166, 168, respectively having substantially cross-like shapes into which a pair of flat, rigid plates 170, 172 of similar cross-like shape may be inserted flush with the surface of the rail facing surface 120 and seated. The plates 170 and 172 may be stamped from a thin metal such as steel plate. The plates 170, 172 are provided to.resist the cutting action of the sharp rail edge from damaging block 10. The plates 170, 172 are positioned at critical impact points on the surface 120 that are opposite points where upper and lower rail edges might cut into the standoff block 10 when the guardrail is bent inwardly during vehicle impact.

Each plate 170 and 172 may be affixed to the block 10 by a pair of fasteners 174A, 174B and 176A, 176B, respectively, which may be driven into the block adjacent the opposite inside corners formed by the cross-shape of the plates. Two sets of holes are molded into the block to facilitate the insertion of the fasteners 174 and 176 at two or more locations adjacent the plates.

Support struts 154(A) . . . (N), where N is any number that comports with the design of block 10, extend from base 136 on sidewall 112B. Support struts 194(A) . . . (N), where N is any number that comports with the design of block 10, extend from base 136 on sidewall 112A. Support struts 194 have corresponding terminal portions 161(A) . . . (N) that enhance the stability of block 10 when it is mounted on a support post and supporting a section of guardrail. Support struts 196A and 196B are disposed on surface 118 and have terminal portions 151A and 151B, respectively, that extend to provide support for a section of guardrail, when the guardrail is mounted on block 10. Support struts 198A and 198B extend in an opposite direction from base 136 on surface 118. Surfaces 114 and 116 have similar struts, which are not shown in FIG. 1.

Support struts 185, 187, 189, 191, 193 and 195 are mounted on edge portions of block 10.

As seen in FIG. 2, the block 10 has dimensions so it fits against the vertically embedded support post and behind the rail section. Thus, a central-longitudinal axis, referred to herein as the vertical axis, of the block 10 is shown as section line 3—3. A central-horizontal axis, referred to herein as horizontal axis is designated as section line 5—5. Horizontal axis 5—5 perpendicularly intersects vertical axis 3—3 at the intersection of lines 3—3 and 5—5.

The block 10 is usually mounted with its vertical axis 3—3 substantially parallel to a longitudinal axis of the post, which abuts block surface end (shown as surface 122 in FIG. 1). The horizontal axis 5—5 of the block is usually perpendicular to the vertical plane of the rail when the rail abuts block surface 120.

Sidewalls 112, 114, top and bottom surfaces 116, 118 and throughbores 124, 126 are also shown in FIG. 2.

Figure 3:
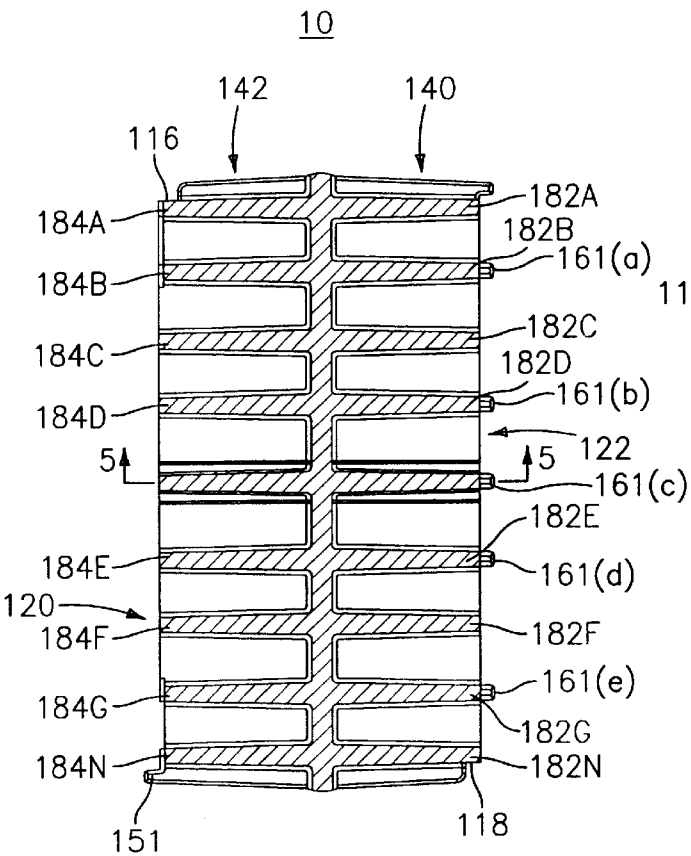
FIG. 3 shows a sectional view of the block illustrated in FIG. 2.taken through lines 3—3 thereof and shows one-half of the interior of the cavitated block.

As seen in FIG. 3, the block 10 can be fabricated in a mold having an overall, substantially H-shaped cross-section with vertically spaced apart parallel, depending, closed-ended core that is designed to form the cavitated module interior. The parting line of the mold is the vertical axis at the midpoint of the base channel. The size and shape of the rectangular cavity webbing or sidewalls are determined by the core pattern of the fingers 182(A) . . . (N) of module 140. (N is any number that is compatible with the design of module 140.) Module 142 has core fingers 184(A) . . . (N), which are disposed opposite corresponding core fingers 182(A) . . . (H), respectively. The core fingers, generally 182, 184, have open ends extending perpendicularly from the vertical base channel defining the base and the crossbar of the H-shaped mold. These are used to direct the flow of the molten plastic material into the closed-ended core fingers 182, 184 where it knits with the plastic in the base channel upon cooling. Thus, the flow of molten plastic is from the center or parting line of the mold into the core fingers 182, 184 where cooling and solidification occur. Because.the different core fingers of each module 140, 142 are horizontally aligned with one another, and are almost one-half the length of core fingers of a conventional substantially U-shaped block having similar horizontal dimensions, the process of injecting the molten plastic into the mold is faster with less opportunity for premature cooling in the core fingers defining the cavity sidewalls and the outermost portions of the sidewalls. The subsequent removal of the solidified block is facilitated by opening the mold along a control parting line. The core fingers 182, 184 are slightly tapered from the base to facilitate their removal from the mold after solidification.

Rear terminal portions 161(A) . . . (N) extend beyond surface 122 to enhance the stability when the block 10 is mounted to a support post.

Support member 151 on surface 120 supports a mounted section of guardrail.

As.seen.in FIG. 4, each of the modules 140 and 142 are molded with a plurality of open-ended cavities 146(A) . . . (N), where N is.any suitable number that comports with the design of block 10, and 144(A) . . . (N), where N is any suitable number that comports with the design of block 10, respectively. These cavities, generally referred to as 146, 144, open in horizontally opposite directions and bottom out at the common, vertically disposed base 136. The individual cavities 146 of module 140 are of similar size and shape as their horizontal counterpart cavities 144 of module 142 and are substantially symmetrical. The dimensions and arrangements of the individual cavities 144, 146 may vary from those explicitly depicted in FIG.4. Indeed, the dimensions and arrangements of the individual cavities may be any configuration that enhances the compression-resisting properties of the block 10. Terminal portions 161 are also shown in FIG. 4.

FIG. 5 shows a sectional side view of the block 10 shown in FIG. 2 through section line 5—5. FIG. 5 shows modules 140 and 142. Rail-facing surface 120 and post-facing surface 122 and cavities 144 and 146 are also shown.

Figure 6:
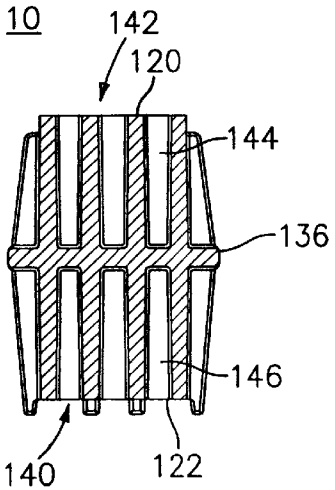
FIG. 6 shows a sectional side view of the block shown in FIG. 2 taken trough section line 6—6 of FIG. 2.

FIG. 6 shows a sectional side view of the block 10 shown in FIG. 2 taken through section line 6—6. FIG. 6 shows modules 140, 142, surfaces 120 and 122, support base 136, cavities 144, 146 and core fingers 182, 184.

Figure 7:
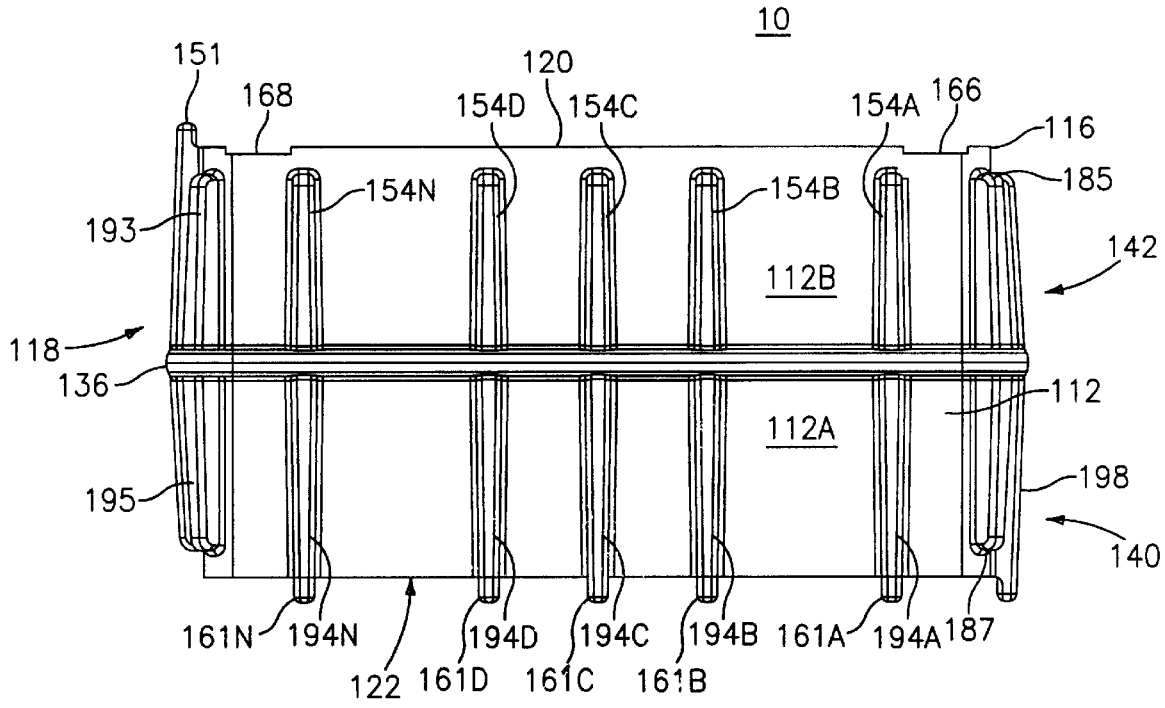
FIG. 7 shows a side elevation view of the block shown in FIG. 1, showing horizontal reinforcing struts on the block exterior.

As seen in FIG. 7, the edges of the base 136 may extend outwardly in a vertical plane from the sidewall 112. Only surface 112 is shown in FIG. 7, and opposite surface 114 is shown in FIG. 1 and has a similar edge. This edge 136 also extends from respective top and bottom walls 116 and 118 of the block 10 thereby forming a.peripheral shoulder from which a plurality of horizontal support struts 154(A) . . . (N) (where N is any number compatible with the design of the block) extend away from base 136 on surface 112B. A plurality of support struts 194(A) . . . (N) extend from base 136 on surface 112A. Opposite surfaces shown herein as 114A and 114B have similar struts, which are not shown in FIG. 7. The struts, generally 154, 194, are molded integral with the modules 140, 142 and extend parallel to the horizontal axis of the block 10. The struts 194 have terminal portions 161(A) . . . (N) that are spaced apart in a lateral direction to span the opposite vertical edges of a support post (not shown) and serve to center the block 10 laterally on the post.

FIG. 7 also shows surfaces 166 and 168 and guardrail support member 151. Struts 193 and 195 are in proximity to bottom surface 118 and struts 185 and 187 are in proximity to top surface 116.

Figure 8:
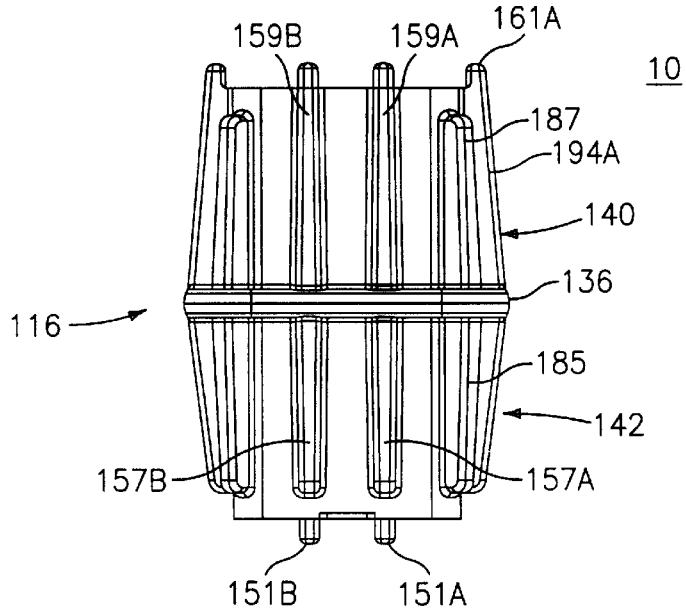
FIG. 8 shows a top view of the block illustrated in FIG. 1, showing the horizontal arrangement and extensions of the reinforcing struts.

FIG. 8 shows a top view of block 10. Struts 157(A) and 157(B) are disposed on the top surface of module 142 and struts 159(A) and 159(B) are disposed on top surface of module 140. Terminal portions of struts 159A and 159B extend from module 142 to overlap the post top so as to support the block 10 vertically on the post during installation of the block on the post. Terminal portions 151A and 151B extend from module 142 to support the guardrail.

It is to be understood that the present invention is not to be considered as limited to the specific embodiments described above and shown in the accompanying drawings, which merely illustrate the best mode presently contemplated for carrying out the invention, and which is susceptible to such changes as may be obvious to one skilled in the art, but rather that the invention is intended to cover all such variations, modifications and equivalents thereof as may be deemed to be within the scope of the claims appended hereto.

What is claimed is:

1. A standoff block structure for mounting a rail structure of a roadway guardrail to a support post, the block piece mounted there between and composed at least partially of recycled plastic material, the standoff block comprising:

first and second elongated block elements of substantially rectangular cross-sectional shape for providing impact resistance to the guardrail, each of the block elements having a longitudinal axis, a cored interior formed by longitudinally extending open-ended cavities having open ends thereof at one end of each of the block elements, wherein the open end of the first block element is adapted to abut the rail structure and the open end of the second block element is adapted to abut the support post;

a buttressing structure for the block element;

a central plate disposed substantially perpendicularly to the longitudinal axis and interposed between the ends of the block elements opposite the open ends thereof, the plate joining the opposite ends of the block elements and defining the bottoms of the cavities; and at least one bore, extending through the block elements and the plate in a direction substantially parallel to the longitudinal axis for receiving a rail mounting fastener.

2. The structure as claimed in claim 1, wherein the plate extends transversely beyond the block elements to provide a support base for the buttressing structure.

3. The structure as claimed in claim 2, wherein the buttressing structure additionally comprises, a plurality of support struts positioned on the base and extending there from to engage at least one of the block elements.

4. The structure as claimed in claim 3, wherein a first set of the struts extend in one direction from the base to engage the first block element and a second set of the struts are oppositely extended from the base to engage the second block element.

5. The structure as claimed in claim 4, wherein certain ones of the first set of struts abut the first block element longitudinally inwardly of the one end thereof for accommodating the rail structure.

6. The structure as claimed in claim 5, wherein the second set of struts project longitudinally beyond the one end thereof for engaging a side of the support post.

7. The structure as claimed in claim 5, wherein at least one of the first set of supporting struts projects beyond the one end of the block elements for supporting a lower rail edge.

8. The structure as claimed in claim 1, further comprising at least one rigid member mounted on the rail end of the block element for resisting displacement of the rail into the block element.

9. The structure as claimed in claim 8, wherein a pair of rigid members are mounted on opposite ends of the rail end of the block element.

10. The structure as claimed in claim 9, wherein the rigid members are fixedly mounted to the block element.

11. The structure as claimed in claim 10, wherein a portion of the strut projects beyond the rigid member to engage the bottom rail edge.

12. The structure as claimed in claim 1, wherein each of the cavities in the first and second block elements has its axis disposed substantially perpendicular to the plane of the central plate.

13. The structure as claimed in claim 12, wherein the cavities in the first block elements are in substantial axial alignment with corresponding cavities in the second block element.

14. A plastic standoff block for mounting a guardrail to an upright support post, comprising:

a pair of cavitated-open ended modules for resisting impact forces, each of the modules being enclosed by a pair of spaced apart, substantially parallel sidewalls and a rearward end wall portion joining the sidewalls to provide a structure of substantially H-shaped cross-section, each of the modules further enclosed by respective upper and lower parallel edge walls joined to opposite respective ends of the structure, wherein the sidewalls have a central axis extending therebetween in a vertical direction and the edge walls have a central axis extending therebetween in a horizontal direction and intersecting the central, vertically disposed axis at a substantially right angle thereto;

a plurality of elongated, vertically spaced-apart interior walls extending from the rearward end wall portion substantially the length of the sidewalls to form the cavitated end of each of the modules, and the rearward end portions being joined together to mount the modules in longitudinal alignment with the cavitated ends thereof positioned to face the guardrail and post, respectively.

15. The block as claimed in claim 14, further comprising a plurality of exterior elongated buttressing elements extending from the rearward end portions of each module substantially parallel to the horizontal axis and toward the cavitated ends of the modules for buttressing the block.

16. The block as claimed in claim 15, further comprising a vertically disposed exterior shelf projecting from the sidewalls adjacent the rearward end portions to provide a common support base for the buttressing elements.

17. The block as claimed in claim 16, wherein the buttressing elements are formed integral with the support shelf and the block modules.

18. The block as claimed in claim 17 wherein the buttressing elements are inclined from the support shelf inwardly toward the outer ends of the modules.

19. The block as claimed in claim 18, wherein a first pair of the elements extending from the shelf have the remote ends thereof terminating inwardly of the outer ends of the modules.

20. The block as claimed in claim 19 wherein a second pair of buttressing elements on the sidewalls project horizontally therefrom to span the upright support post and facilitate lateral alignment therewith.

21. A standoff block molded from plastic material, comprising:

first and second block elements, each block element having a honeycomb interior formed by plural, laterally spaced elongated interior walls having substantially parallel longitudinal axes; and a support wall interposed between the walls perpendicular to the longitudinal axes and joining the first and second block elements in a fixedly aligned relationship.

22. The block as claimed in claim 21, further comprising a plurality of exterior elongated support struts molded on the first and second block elements and extending substantially parallel to the longitudinal axes to buttress the first and second block elements.

23. The block as claimed in claim 22, wherein the honeycomb interiors of the first and second block elements that are remote from the support wall are open-ended cavities.

24. The block as claimed in claim 23, wherein the elongated support struts project longitudinally beyond the remote portion of one of the block elements and straddle a post in a transverse direction.

* * * * *